United States Patent [19]

Sacherman et al.

[11] Patent Number: 4,817,284

[45] Date of Patent: Apr. 4, 1989

[54] ERGONOMIC UTILITY KNIFE

[76] Inventors: James E. Sacherman, 1550 California Ave., Palo Alto, Calif. 94306; John W. Toor, 425 Alma St., #311, Palo Alto, Calif. 94301

[21] Appl. No.: 24,245

[22] Filed: Mar. 10, 1987

[51] Int. Cl.[4] ..... B65B 1/00

[52] U.S. Cl. ..... 30/329; 30/330

[58] Field of Search ..... 30/329–344

[56] References Cited

U.S. PATENT DOCUMENTS 3,934,591 1/1976 Gleason ..... 30/329 X

FOREIGN PATENT DOCUMENTS 90256 10/1983 European Pat. Off. ..... 30/335

144607 10/1920 United Kingdom ..... 30/337

*Primary Examiner*—Douglas D. Watts

*Attorney, Agent, or Firm*—James E. Eakin

[57] ABSTRACT

A utility knife having a handle with a shaft portion and a lower protrusion for improved ergonomics is disclosed. The shaft portion has a bore for receiving a collet and the knife includes a central knob for cooperating with the collet to clamp a blade into the collet when the knob is rotated in a first direction and to move the collet axially out from the handle, thereby freeing the blade, when the knob is rotated in the other direction.

4 Claims, 3 Drawing Sheets

ERGONOMIC UTILITY KNIFE

FIELD OF THE INVENTION

The present application relates to knives, and in particular to knives having collet-locked removable blades.

BACKGROUND OF THE INVENTION

Utility knives, such as are used in the graphic arts, handicrafts, modeling and other diverse applications in homes, factories and offices, have long been known. A standard form of such a utility knife involves a removable, relatively short blade fastened in some means to a shaft or other form of handle.

In one well known version of a utility knife, the blade is fixed to the shaft through a threaded collet. The collet is becomes more tightly held as the collet is screwed int the shaft. In other such knives, all or a portion of the shaft may be hexagonal, rectangular, or knurled, but nearly always straight Perhaps the most famous of such knives are those sold under the X-Acto mark.

Unfortunately, such well-known knives suffer from a number of limitations. Two significant considerations in the design of utility knives having such broad application are control and safety. However, designs of utility knives known in the prior art, while inexpensive, typically provide little consideration to conforming the handle to the hand in a manner which imparts such control and safety.

Most particularly, the simple, straight shaft, often as small as a pencil, of the prior art utility knife can rotate away from the object, creating a loss of control that increases risk of injury to the user as well risk of damage to the object.

Additionally, the typical collet lock of the prior art frequently binds on the blade, forcing the user seeking to change blades to tug or otherwise directly contact the blade to force it out of the collet. Alternative designs are also known in the prior art which maintain angles and friction such that the collet is intended to ride freely in its sleeve, but these designs have been found unreliable because friction between materials may vary widely with changes in operating conditions that may be encountered over the useful life of the knife.

These and other limitations of the prior art have established a need for a simple, inexpensive, easy to control and relatively safe utility knife.

SUMMARY OF THE INVENTION

The present invention eliminates or substantially reduces each of the aforementioned limitations of the prior art. The knife of the present invention involves an ergonomically shaped handle which includes a protrusion out of the lower surface. The protruding lower surface permits the utility knife of the present invention to be firmly gripped, but without significant strain, between the thumb, forefinger and middle finger. The arrangement is configured to conform to a wide range of human hand sizes, and to permit the knife to be gripped in a variety of positions.

In addition, the collet-locking mechanism of the present invention includes a rotatable central knob located between two fixed sections The collet extends through the front section of the handle and screws into the central knob. The front section of the handle includes a bore angled to applies a compression force against the collet by which the blade is clamped into the collet as the central knob is rotatably tightened. Conversely, as the central knob is rotated to loosen the collet, the collet is moved axially out from the front section of the handle.

In addition, alignment of the blade relative to the handle is provided by a slot provided in the tip of the front section of the handle. As the collet is tightened, the back section of the blade is pulled into the slot, thereby accurately aligning the blade.

It is therefore one object of the present invention to provide a utility knife having improved safety characteristics.

It is another object of the present invention to provide a utitlity knife with improved control characteristics.

It is yet another object of the present invention to provide an ergonomic utility knife.

It is a further object of the present invention to provide an ergonomic utility knife which safely ejects a collet locked blade.

It is a still further object of the present invention to provide a knife capable of being ergonomically held in a variety of hand positions.

It is yet a further object of the present invention to provide a knife capable of being comfortably held by a wide range of hand sizes.

It is still another object of the present invention to provide a utility knife capable of quickly aligning a removable blade relative to the handle.

These and other objects of the present invention may be more fully appreciated from the following Detailed Description of the Invention, in which FIG. 1 shows a elevational side view of the utility knife of the present invention;

FIG. 2 shows the knife of the present invention held by a user in one of the many possible positions;

FIGS. *3a–3b* show in front view and in cutaway cross sectional side view the collet locking mechanism of the present invention;

FIGS. *4a–b* show is cutaway cross-sectional front and side views the blade aligning features of the present invention, with FIG. *4a* taken along the section lines shown in FIG. *4b;* and FIG. 5 shows the knife of the present invention including a cap.

DETAILED DESCRIPTION OF THE INVENTION

Figure 1:
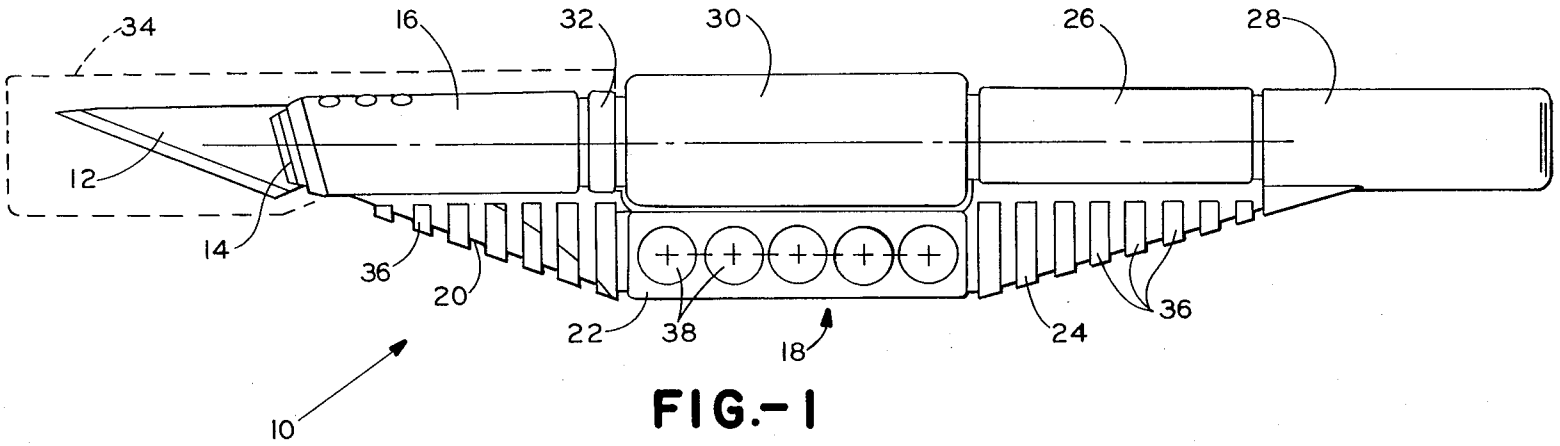

Referring first to FIG. 1, the utility knife 10 of the present invention may be seen as a whole. The blade 12 may be seen to be fitted into a collet 14, which in turn is substantially wholly inserted into a front rounded section 16 of an overall handle 18. The handle 18 further includes an angled front protrusion 20, a flatted middle protrusion 22, and an angled rear protrusion 24. The handle further includes a rounded section 26 located above the angled rear protrusion 24. A rear cap 28, discussed in greated detail in connection with FIG. *3b*, is also provided. The handle 18, including each of its elements 20–26, is preferably formed as an integral whole, and may be formed of any suitable material such ABS, reinforced ABS, nylon, reinforced nylon, reinforced polystyrene, or aluminum, or other materials. Any suitable process may be used, such as injection molding, casting, or other processes.

Located between the front section 16 and the rear section 26 of the handle 18 is a rotatable central knob 30.

Figure 3B:
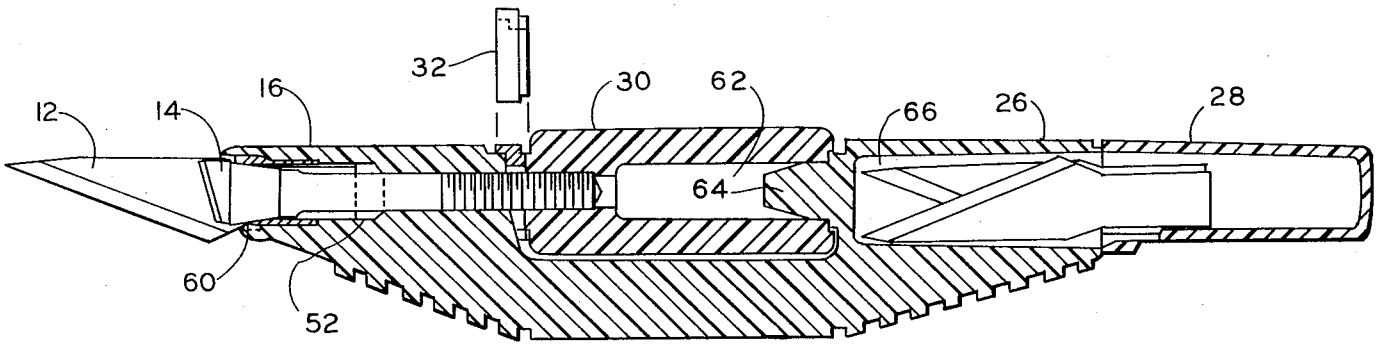
Figure 3A:
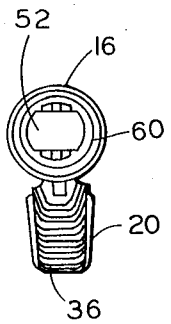

As will be better appreciated from FIGS. 3*a–b*, also shown in FIG. 1 is a snap ring 32 at the forward junction between the central knob 30 and the rounded section 16 of the handle 18. The snap ring maintains a close axial tolerance at the knob-handle interface, thereby materially improving the stiffness of the knife 10 as a whole. This also permits a change in material between the knob 30 and the handle 18, if desired, reducing the possibility of galling and seizing commonly found in compressive junctions between like plastics. In the embodiment described here, the central knob 30 may be formed of ABS or, if desired, lubricated ABS.

Figure 5:
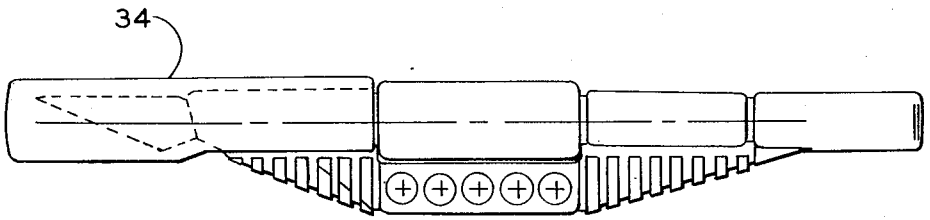

A removable cap 34, shown in phantom in FIG. 1 but shown installed in FIG. 5, may also be provided for use during storage or transport of the blade. Because the cap may be made of plastic, and is retained in place by a snap fit onto the preferably plastic handle 18, a secure connection may be obtained even with the use of inexpensive materials. The cap preferably includes an axial slot on the ventral side thereof so that the cap may slide over the handle 18 and mate thereagainst at or just before the snap ring 32. The axial slot may also be formed to provide a retentive force against the handle 18.

It will also be appreciated from FIG. 1 that the angled protrusions 20 and 24 may have thereon a series of ribs 36, designed to improve the frictional characteristics of the knife 10 so that it may be more readily gripped without significant strain. In addition, the flat protrusion 22 may also include dimples 38 or other surface modifications to improve the ease with which the knife may be gripped. Additionally, the front section 16 of the handle 18 may include a plurality of dimples 40, for example six dimples arranged in two symmetrical rows, of which one row of three is shown in FIG. 1. It will be appreciated that these surface modifications are not required in all embodiments of the present invention. The section 16 may vary within a wide range of diameters, but a diameter on the order of ten millimeters has been found acceptable for a wide range of hand sizes.

Figure 2:
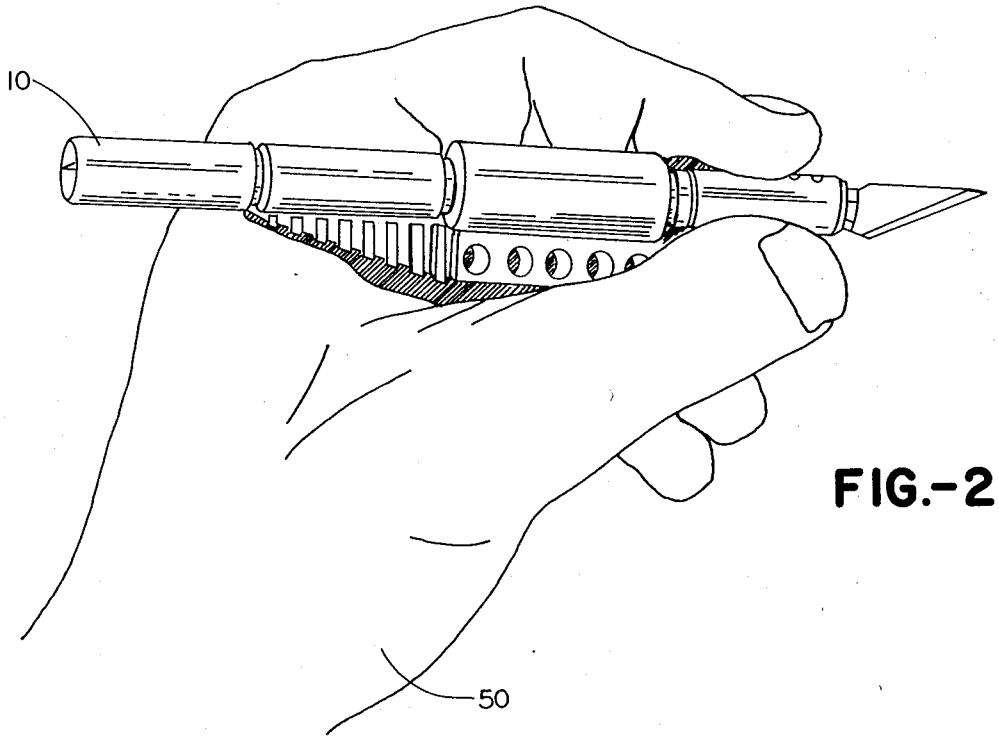

Referring next to FIG. 2, the knife 10 may be seen as held in the hand 50 of a user. It can be appreciated that the contoured handle 18, including particularly the angled protrusions 20 and 24 and the flat protrusion 20, can be readily gripped between the thumb, forefinger and middle finger. The rounded front section 16 permits some rotation between these fingers, although neither the section 16 nor the section 26 nor the cap 28 need be round in all embodiments.

The angled protrusion 20 limits the rotation permitted by the section 16, and provides an area for substantially increased contact between the knife 10 and the thumb and middle finger. It will be appreciated by those skilled in the art that this contact area is particularly significant for maintaining maximum control of the knife 10, thereby increasing the safety of the knife during use.

It can further be appreciated from FIG. 2 that the wider midsection, or middle protrusion 22, of the knife provides contact between the knife and the knuckle area where the fingers diverge when gripping an object. Finally, the rear section 26 and cap 28 combine with the angled protrusion 24 to provide a large area of contact with the fleshy area of the hand between the thumb and forefinger.

While FIG. 2 shows one common grip for holding a utility knife, it will be appreciated that numerous other grips are used. It is believed that the foregoing description of the fit between the hand and knife in one grip will be sufficient to permit those skilled in the art to understand the ergonomic fit between the handle and the human hand when the knife is held in other grips.

Referring next to FIGS. 3*a* and 3*b*, additional features of the knife 10 can be better appreciated. The blade 12 can be seen to be fully inserted into the collet 14. The collet includes threads at its rightmost end, and the threaded portion extends through a bore 52 in the front section 16 of the handle 18. The threaded portion of the collet is threaded into mating threads inside the central knob 30.

It may further be seen that a tension sleeve 60 is located inside the front portion of the bore 52. The tension sleeve 60 is not necessarily required in all embodiments, but is helpful to contain the hoop stresses generated by the axial force of the collet applied through the ramp angles that compress the collet onto the blade. It will be appreciated that the compressive stresses generated by the axial force are transferred to the handle 18. Where the material forming the handle has sufficient tensile strength to withstand the hoop stresses and thereby maintain the collet in a sufficiently rigid manner, the tension sleeve is unnecessary. However, by the present design, the tension sleeve is kept sufficiently simple that it may be inexpensively formed by stamping. Additionally, the design of the tension sleeve 60 permits the blade 12 to contact the plastic handle as will be further discussed hereinafter in connection with FIG. 4*a*.

Referring still to FIGS. 3*a–3b*, an axial bore 62 may be seen to exist in the knob 30. Likewise, an axial projection 64 in the form of a truncated cone exists at the front of the rear section 26, mated to the axial bore 62 so that the knob 30 may be fixedly positioned between the front section 16 and rear section 26 of the handle 18. A close fit preferably is maintained between the diameter of the projection 64 and the diameter of the bore 62.

Because of the snap ring 32, the knob 30 may be placed in position over the projection 64 and then fixed in place, which rigidly fixes the knob into the handle in a manner which permits it to rotate freely without twisting laterally and without moving axially in either the backward or forward direction. When the collet 14 is threaded into the knob 30, the combination of the blade, sleeve, collet and knob provide increased stiffness to the handle, thereby ensuring that the handle will not flex excessively under the forces applied during normal use. The snap ring 32 also retains the knob in place even when the collet 14 is completely removed.

An additional feature of the cooperation between the knob and the handle 18 is the automatic ejection of the collet, and corresponding loosening of the blade 12, when the knob 30 is unscrewed relative to the collet 14. Because the knob is fixed axially, only the collet can move during tightening and loosening, providing a substantial improvement in the operating safety of the knife of the present invention.

Still referring to FIGS. 3*a–3b*, a blade storage area 66 may be provided inside the rear section 26 and rear cap 28. The rear cap 28 may be mounted to the handle in any conventional manner, such as frictional, threaded or snap fits or any other acceptable manner.

With reference particularly to FIG. 3*a*, the front angled protrusion 22 may be seen in front view, and it may be appreciated that the protrusion is shaped with a concave spherical radius to conform to the fingers. However, such shaping is not required in all embodiments of the invention. The substantially corresponding shapes of the bore 52 and the collet 14, including flatted upper and lower portions, may also be appreciated from FIG. 3*a*. The flatted portion of the collet 14 is helpful in aligning the blade within the handle 18, as will be better appreciated from FIGS. 4*a*–4*b*.

Figure 4B:
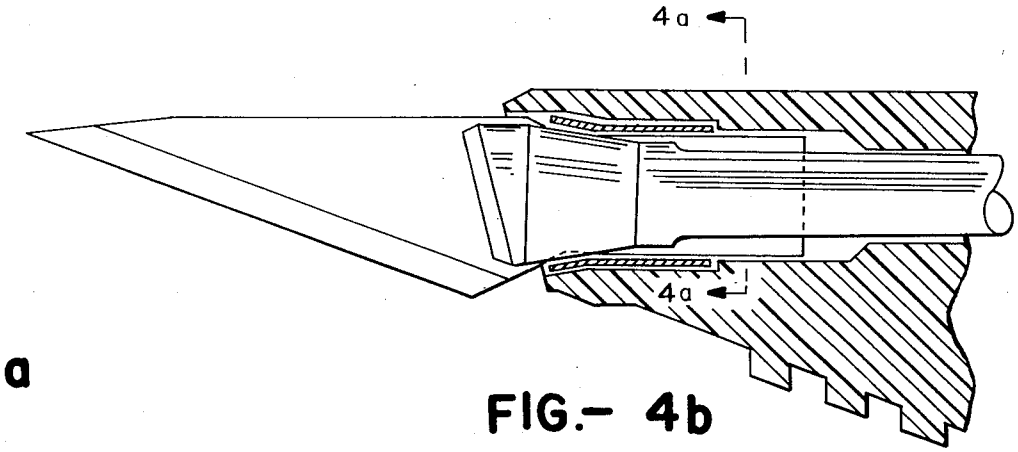
Figure 4A:
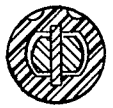

Referring next to FIGS. 4*a*–4*b*, the features of the present invention which provide automatic alignment of the blade within the handle can be better appreciated. From FIG. 4*b*, it can be seen that the rear portion of the blade 12 extends beyond the tension sleeve 60. As can best be seen from FIG. 4*a*, a slot 68 exists within the bore 52 and receives the rear portion of the blade 12. The slot 68 may be seen in cutaway view in FIG. 4*b*. By virtue of the flatted portion of the collet 14, and the corresponding flatted portion of the bore 52, the blade is initially maintained in a gross alignment within the handle 18. The alignment provided by the flatted collet and bore may be within five or ten degrees. As the blade is inserted into the collet and bore, the blade is guided into the slot 68, which permits accurate alignment of the blade relative to and within the handle. It will be appreciated that the flatted portion of the collet exposes additional area of the blade, to permit a slightly deeper slot to be used and thereby to improve the alignment of the blade. It can be seen from FIG. 4*b* that the only portion of the blade which may be fitted into the slot is that portion which extends beyond the tension sleeve 60 and the collet 14.

Having described in detail one embodiment of the present invention, numerous other alternatives and equivalents which do not depart from the present invention will be apparent to those skilled in the art, given the teachings herein. The present invention is therefore not to be limited by the foregoing description, but only by the appended claims.

What is claimed is:

1. A utility knife comprising a handle having a forward shaft portion and an aft shaft portion with a space therebetween, and further having a lower protrusion including front, middle and rear portions, the forward shaft portion of the handle having a central axial bore therethrough, a vertical slot within a portion of the bore capable of receiving the rear portion of a blade to maintain alignment between a blade and the handle, and including a tension sleeve therein, the aft shaft portion including an axial projection into the space between the forward shaft portion and the aft shaft portion, a central knob having a threaded, central axial bore in the forward portion thereof and an axial bore in the rear portion thereof capable of being disposed around the axial projection and into the space between the forward shaft portion and the aft shaft portion such that the central knob is relatively fixedly positioned axially but freely rotatable, a collet adapted to receive a blade in one end thereof and having a threaded portion at the other end thereof capable of extending through the central axial bore in the forward portion of the shaft, including the tension sleeve, and of being threaded into the central axial bore in the central knob, such that a tightening rotation of the central knob relative to the collet increases the clamping force on a blade held within the collet, while a loosening rotation of the central knob relative to the collet decreases the clamping force and moves the collet axially outward relative to the central knob.

2. A utility knife having a handle comprising a shaft portion and a lower protrusion and including a central axial bore through at least a part of the shaft portion, a central knob positioned within an opening in the handle, the central knob being fixedly positioned axially but freely rotatable, the central knob having a threaded axial bore extending at least partially therethrough, a collet adapted to receive a blade in one end thereof and having a threaded portion at the other end thereof capable of extending through the central axial bore in the shaft portion of the hand and of being threaded into the axial bore in the central knob, such that a tightening rotation of the central knob relative to the collet increases the clamping force on a blade held within the collet, while a loosening rotation of the central knob relative to the collet decreases the clamping force and moves the collet axially outward relative to the central knob, and slot means within the central axial bore through the shaft portion for aligning the blade relative to the handle as the collet is tightened around the blade by the rotation of the knob.

3. A utility knife having a handle comprising a shaft portion and a lower protrusion and including a central axial bore through at least a part of the shaft portion, a central knob positioned within an opening in the handle, the central knob being fixedly positioned axially but freely rotatable, the central knob having a threaded axial bore extending at least partially therethrough, a collet adapted to receive a blade in one end thereof and having a threaded portion at the other end thereof capable of extending through the central axial bore in the shaft portion of the hand and of being threaded into the axial bore in the central knob, such that a tightening rotation of the central knob relative to the collet increases the clamping force on a blade held within the collet, while a loosening rotation of the central knob relative to the collet decreases the clamping force and moves the collet axially outward relative to the central knob, a hollow portion in the end of the shaft opposite the collet to create a storage area, and cap means capable of being removably attached to the shaft at the hollow portion thereof for enclosing the storage area.

4. An ergonomic utility knife having an ergonomic handle comprising a shaft portion and a non-axial projection therefrom for fitting the handle to the hand, the non-axial projection having a substantially trapezoidal shape from the side elevational view and being substantially the same width as the shaft portion, and the shaft portion having a central axial bore and a tension sleeve contained within the central axial bore, and collet means affixed to the shaft for receiving and fastening a blade into an operating position, the blade being fastened within the collet by tightening the collet against the tension sleeve within the axial bore such that the tension sleeve distributes the load stresses caused by the compression of the collet against the blade and helps prevent fracture of the shaft.

* * * * *